United States Patent [19]

Apissomian

[11] 4,092,791

[45] June 6, 1978

[54] STORED INFORMATION DISPLAY APPARATUS

[76] Inventor: Arthur A. Apissomian, 411 Westchester Ave., Mt. Vernon, N.Y. 10552

[21] Appl. No.: 682,644

[22] Filed: May 3, 1976

Related U.S. Application Data

[63] Continuation of Ser. No. 576,285, May 12, 1975, abandoned, which is a continuation of Ser. No. 392,564, Aug. 29, 1973, abandoned.

[51] Int. Cl.[2] ..... G09F 11/30; G09F 7/00

[52] U.S. Cl. ..... 40/470; 40/573; 40/576; 40/502

[58] Field of Search ..... 40/36, 132 F, 132 D, 40/137, 130 H

[56] References Cited

U.S. PATENT DOCUMENTS

| | | | |
|---|---|---|---|
| 1,636,415 | 7/1927 | Greenawalt | 40/137 X |
| 2,099,243 | 11/1937 | Taaffe | 40/132 F |
| 3,000,125 | 9/1961 | Elvestrom | 40/137 |
| 3,082,560 | 3/1963 | Elvestrom | 40/137 |

*Primary Examiner*—E. H. Eickholt

*Attorney, Agent, or Firm*—Leon Nigohosian; Martin P. Hoffman

[57] ABSTRACT

An intelligence display apparatus comprising:

(a) an envelope comprising a substantially transparent faceplate:

(b) illumination means for directing light toward said faceplate:

(c) an intelligence selection element disposed between said faceplate and said illumination means, said selection element comprising first regions substantially transparent to said light and second regions substantially opaque thereto, said first and second regions having respective widths in the ratio of about 6:7 to about 8:9;

(d) an intelligence storage element comprising a plurality of discrete and different sets of intelligence, said storage element being disposed between said selection element and said illumination means, said sets individually comprising a plurality of bits respectively embodying different portions of said intelligence, such that said bits of each set collectively comprises a composite of the intelligence of said set, each one being totally opaque, totally transparent, partially opaque and partially transparent to said light, and the bits of the respective said sets of intelligence are sequentially substantially aligned with said first regions when at least one of said information selection element and said intelligence storage element is moved relative to the other, and;

(e) means for moving at least one of said selection element and said storage element with respect to the other so that said bits of respective ones of said sets are sequentially observable through said first regions.

16 Claims, 8 Drawing Figures

FIG. 3
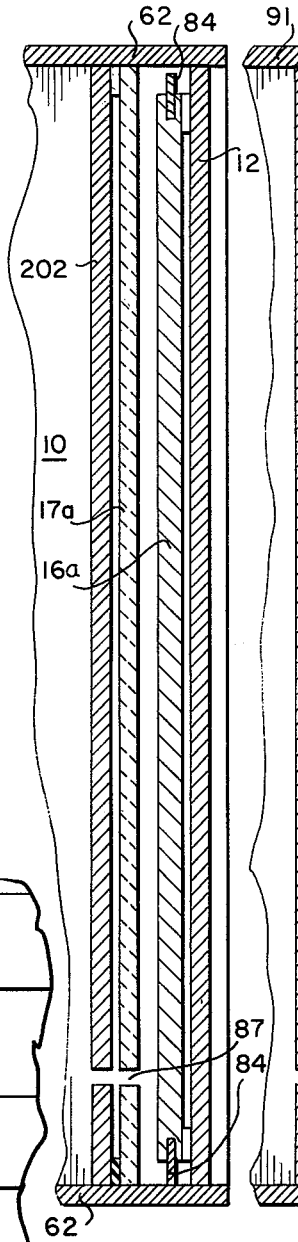
FIG. 4
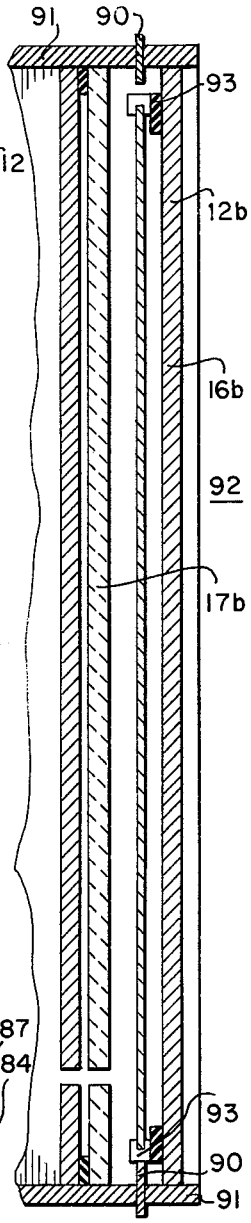
FIG. 7
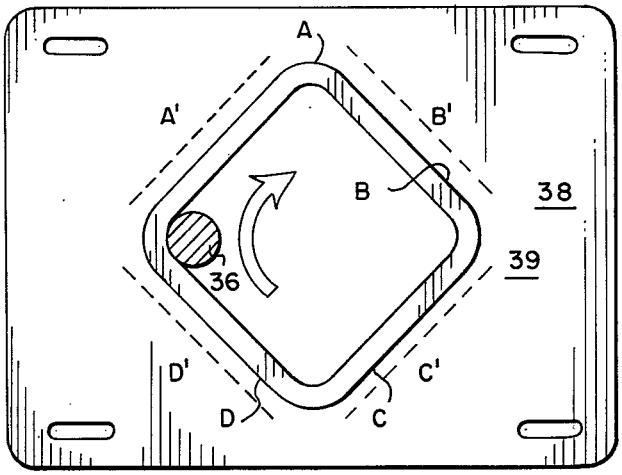
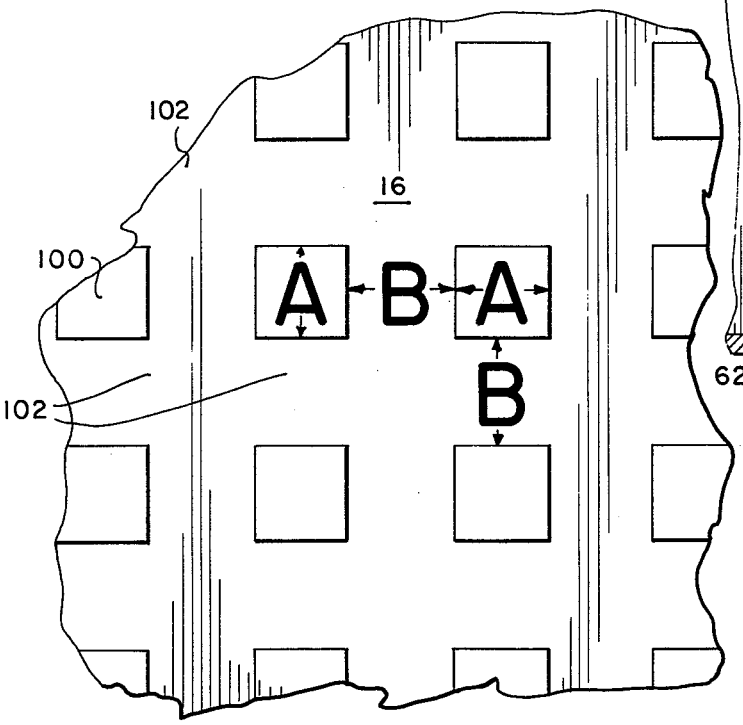
FIG. 5
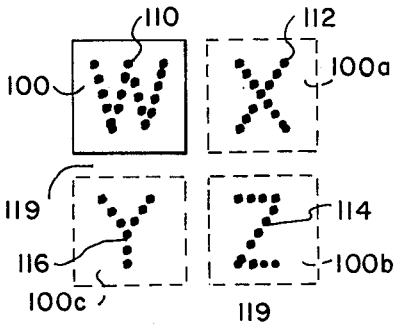
FIG. 6

STORED INFORMATION DISPLAY APPARATUS

BACKGROUND OF THE INVENTION

The present application is a continuation of application Ser. No. 576,285, filed May 12, 1975 (now abandoned), which was, in turn, a continuation of application Ser. No. 392,564, filed Aug. 29, 1973 (now abandoned).

The present invention comprises a display apparatus and, particularly, one for sequentially displaying plural sets of stored information or other intelligence.

While the prior art has described various display apparatus for projecting stored information such have generally required relatively complicated mechanisms for precisely moving various portions of the respective apparatus and/or one or more lens systems, which lead to a costly apparatus and a greater possibility of mechanical malfunctions and even breakdowns. The present invention significantly minimizes, at least, the aforementioned problems encountered in the prior art, and, yet, does not sacrifice the quality of the information display.

Briefly, the present invention includes a display apparatus comprises an illumination means, an information selection element comprising first regions that substantially transmit light from the illumination means and second regions that are substantially opaque to the light; and an intelligence storage element containing plural, and preferably four, separate sets of intelligence, each such set consisting of at least one bit of intelligence, which storage element is disposed between the illumination means and the intelligence selection element. Each such bit is partially or completely transmissive or is totally non-transmissive to light from the illumination source, depending on the intelligence embodied therein.

The intelligence selection element's first regions are spaced apart from each other and substantially correspond, at various times, in number and distribution with the bits of each of the sets of information when the latter are separately considered. The intelligence selection element and the intelligence storage element are disposed relative to each other such that the first regions of the former are substantially in registry with the bits of one intelligence set of the latter, light from the illumination source passing through those bits of the latter, which are in substantial registry with the first regions of the intelligence selector, and then through these first regions toward the viewer. As the light passes through the respective bits, the intensity is altered at various zones thereof in accordance with the degree of transmissivity of such bits.

In one embodiment of the invention, the intelligence selector first regions generally are substantially rectangular, and preferably, square in shape and are arranged in evenly spaced rows and columns. The opaque second regions are in thefform of strips between the various rows and columns of first regions and preferably exceed in width the individual first regions of the intelligence selection element.

In another embodiment, at least the intelligence selection element and the intelligence storage element constitute a unitary structure that is usable as such and is readily handleable, one of these elements being movable with respect to the other to permit the selective extraction of intelligence from the storage element.

In still another preferred embodiment, one of the intelligence selection element and the intelligence storage element is movable with respect to the other (it being especially preferred that the latter be movable with respect to the former) by a motordriven cam mechanism, it being preferred that the motion of the movable one of these elements be along X-Y co-ordinates.

In another embodiment, the apparatus comprises adjustable motion-limiting elements that limit the movement of the movable intelligence storage element or intelligence selection element, as the case may be, to a first position where the first regions of the selection element are in substantial register with the various bits of one of the information sets on the intelligence storage element. Subsequently, the movable element is located at a second position where the first regions are in substantial register with the various bits of another information set, and so on until the desired sets of intelligence are sequentially "read out", the movable element's motion being limited at each re-location thereof, by various ones of the motion-limiting elements. In one preferred mode of operation, the drive mechanism of the apparatus moves the movable element to a position where certain ones of the motion-limiting elements are engaged by the movable element and holds the movable element there for reading out a set of information, until the movable element is sought to be re-located to read out other sets of information, this procedure then being repeated.

BRIEF DESCRIPTION OF THE DRAWINGS

FIGS. 3 and 4 are, respectively, fragmentary sectional side elevation views of the display apparatus of the present invention according to further embodiments.

FIG. 5 is a fragmentary front view of the information selection element according to one embodiment of the invention.

FIG. 6 is a schematic representation of a transmissive region of an information selection element and several information bits of a storage element, one of which is moved to each of four different positions.

FIG. 7 is a top view of a cam plate employed in the present invention.

PREFERRED EMBODIMENT

Figure 1:
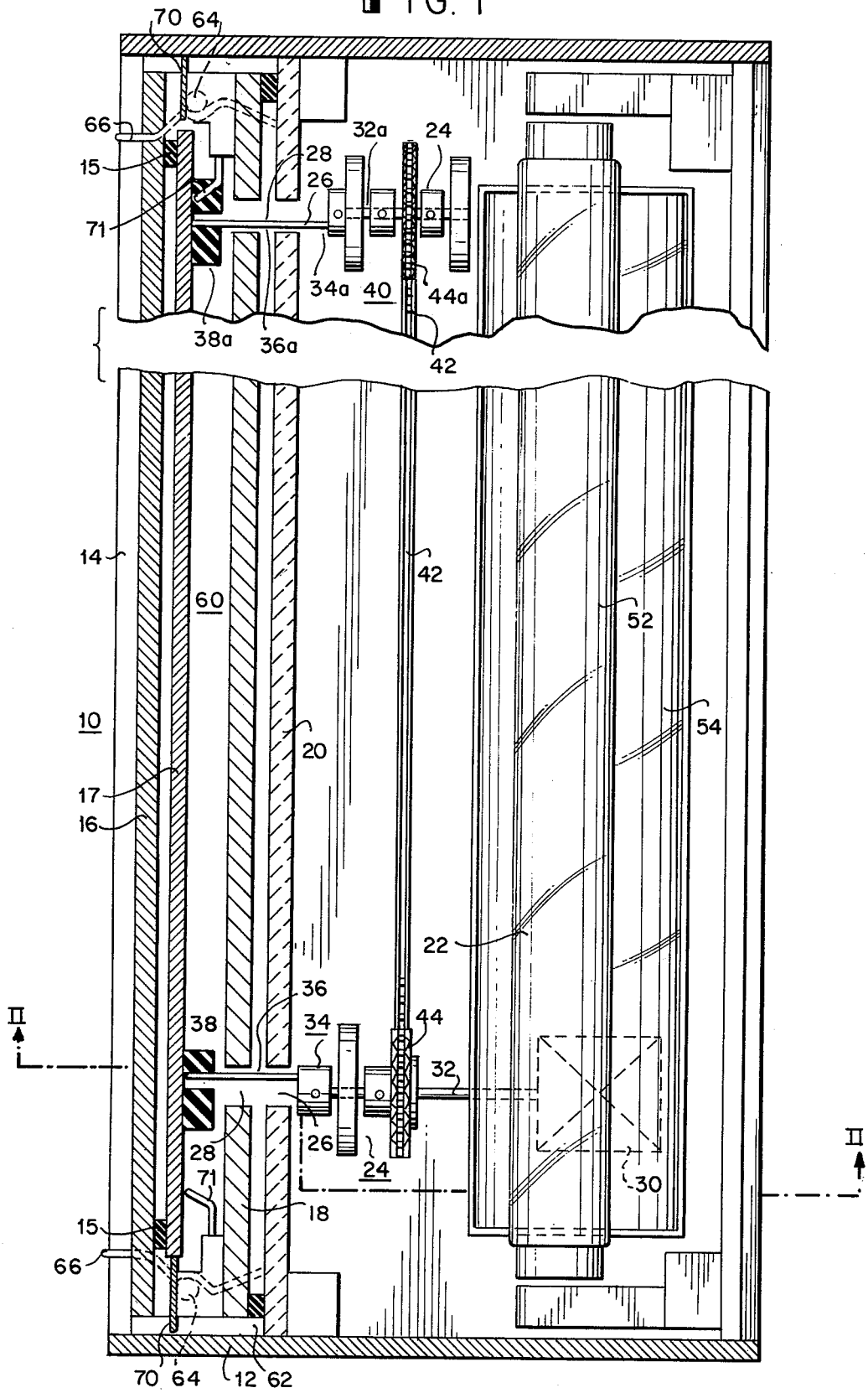
FIG. 1 is a partially cut away top view along axis I-I of a display apparatus of the present invention.

One embodiment of the intelligence display apparatus 10 (FIG. 1) of the present invention comprises an envelope 12 having a faceplate 14 (which may be tinted or untinted) that is at least substantially transparent to certain radiation (described below), the envelope 12 containing an intelligence selection element 16 having a particular configuration and relative dimensional criteria that provide significant advantages, as described in greater detail below; and information storage element 17 disposed opposite the selection element 16; a spacer 15 between the elements 16 and 17; a substantially transparent or translucent plate 18 disposed opposite the face of the storage element 17 remote from the selection element 16, the plate 18 serving as a protective shield to the storage element 17; a light diffusing plate 20; and illumination source 22, the mechanical drive means 24 for moving the storage element 17 with respect to the selection element 16.

The intelligence selection element 16 can form an integral structure with the faceplate 14 or can be a discrete structure that is separate from the faceplate 14. An example of such an integral structure comprising the faceplate 14 and selection element 16 comprises a sheet of transparent material (e.g., glass or plastic that may or may not be tinted so as to reduce reflection of ambient light therefrom toward the viewer, such reflection detracting from the quality of the intelligence veiwed) on which a pattern of substantially transparent and substantially opaque areas are produced, as, for example, by painting, metallizing, etc.

The faceplate 14, intelligence selection element 16, intelligence storage element 17, and protective plate 18 can be joined together to form a unitary structure, or cartridge, that can be readily inserted or removed and handled. Alternatively, one or more of these structural components can be discrete and separate from the others.

The light-diffusing plate 20 can be permanently or semipermanently mounted in the envelope. The light-diffusing plate 20 and the protective plate 18 contain one or more openings or apertures 26 and 28, respectively, via which the intelligence storage element 17 is mechanically linked to the drive means 24.

Figure 2:
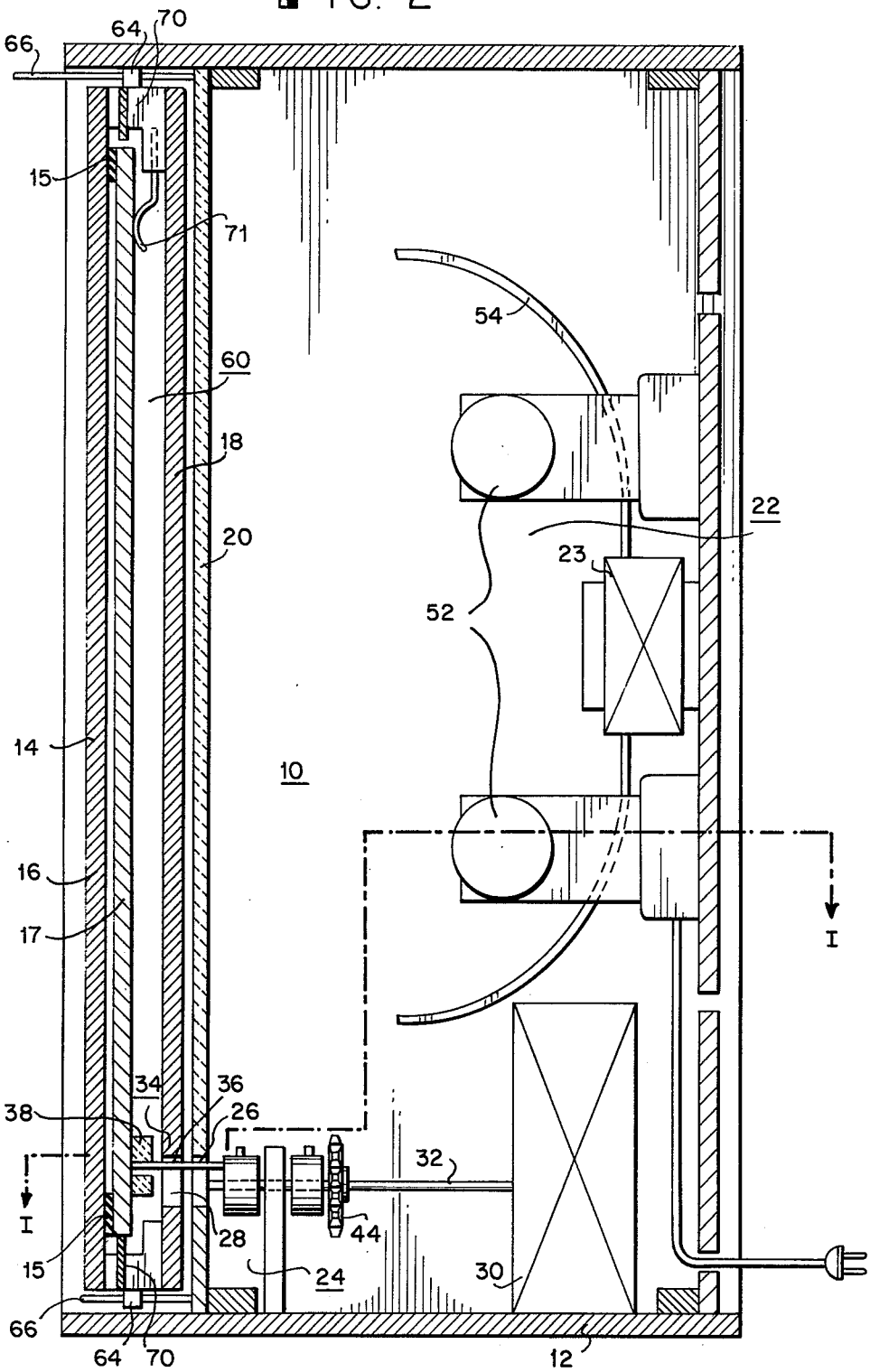
FIG. 2 is a sectional side view along lines II-II of the apparatus shown in FIG. 1.

The drive means 24 comprises a motor 30, a drive shaft 32 connected to the motor 30, a cam assembly 34 comprising a drive rod 36 that engages an adjustable cam plate 38 that is connected to the movable one of the storage element and selection element, the former (17) being shown to be movable in the embodiment depicted in FIGS. 1 and 2. The drive rod 36 preferably is semi-rigid (e.g., a nylon rod or a spring) so as to be deformable when the movable element (i.e., the storage element 17) is stopped at a read out position, but to be sufficiently rigid to drive the movable element at certain other times.

The cam plate 38 (which is of the female type in this particular embodiment) can be located at a peripheral portion of the movable storage element (as shown), with a similar cam assembly **34*a* that contains an adjustable cam plate 38*a* and that is located at another such peripheral portion, the cam assembly 34*a* and its drive rod 36*a* forming part of a second drive means 40. It is preferred that the second cam assembly 34*a* also be driven by the motor 30 used for the first cam assembly 34 via, for example, a sprocket chain 42 that is mounted on the sprockets 44 and 44*a* of the first and second drive means 24 and 40** respectively.

The second drive means **40*a* also comprises a drive shaft 32*a* driven via the sprocket 44*a*, in addition to the second cam assembly 34*a* that includes a drive rod 36*a* that engages the adjustable cam plate 38*a***.

The illumination source 22 of the apparatus 10 preferably includes one or more light bulbs 52, such as fluorescent tubes (as shown), incandescent lamps, quartz lamps, etc., and a reflecting element 54, preferably a mirror having a parabolic transverse configuration, as shown in FIG. 2.

The intelligence storage element 17 can comprise a self-supporting plate (e.g., glass or plastic) on which information is provided, the information being present as an exposed and developed photographic emulsion, for example, that is provided on the plate. Alternatively, the storage element 17 can comprise, inter alia, a sheet of standard photographic film to which the intelligence is imparted by exposure and development. Where a photographic film is used, it generally is necessary to provide a frame (not shown) for supporting it, although a frame might also be desirable where the storage element is self-supporting.

Where, as shown in FIG. 2, the faceplate 14, intelligence selection element 16, intelligence storage element 17, and protective plate 18 form a unitary structure, or cartridge, 60, it is preferred that peripheral walls 62 be provided to hold these parts in their respective positions. Where it is desired, spacers (e.g., 15) may be disposed between the various constituent parts of the cartridge to ensure maintenance of their relative spacings from each other. Nubs 64 are provided at the peripheral walls 62 such that they engage spring elements 66 that are located on the envelope 12, so that the cartridge 60 is held in position.

It is preferred that biasing means, such as a hook spring 71, for example, be disposed between the storage element 17 and the protective plate 18 and engage peripheral portions of the storage element 17, forcing the storage element 17 against the spacers 15 so that the storage element is maintained in a substantially vertical position, the lower portions of the storage element being so maintainable by the drive rods 36 and **36*a* engaging the cam plates 38 and 38*a*. The spring elements 66 located between the envelope walls and the peripheral wall portions of the cartridge 60 maintain the cartridge in a relatively fixed position and yet permit the facile mounting and de-mounting of the cartridge in the apparatus envelope 12**.

In a particularly important embodiment, the apparatus 10 comprises motion-limiting elements 70 that define and limit the paths over which the movable element (i.e., the selection element 16 or, as in FIG. 1, the storage element 17) can be moved. The motion-limiting elements 70 can be disposed at the peripheral walls 62 of the cartridge, as shown in FIG. 1, or provided in some other arrangement, e.g., the motion-limiting elements 84 can be disposed at the periphery (FIG. 3) of the movable element (i.e., the intelligence selection element **16*a*, as in FIG. 3, or the intelligence storage element, e.g., as in FIG. 1). Where the movable element is carried by a frame, the motion-limiting elements can be located on the outer portions of the frame. Alternatively, the motion-limiting elements 90 (FIG. 4) may be located in the walls 91 of the envelope 92 containing the parts of the display apparatus such that the movable element (e.g., the storage element 17*a* in FIG. 4) engages various ones of these motion-limiting elements as it is driven, thereby defining the displacement of the movable element and the path traveled by the movable element. Optimally, two or more motion-limiting elements are located on each of the cartridge peripheral walls or the envelope walls or on each side of the movable element or the movable element frame, as the case may be. Where the motion-limiting elements are located at the peripheral walls of the cartridge (FIG. 1) or at the individual frame of the movable element, e.g. the selection element (FIG. 3), they can engage the walls of the envelope or the peripheral walls of the cartridge, thereby difining the path over which the movable element is driven and the displacement thereof. The motion-limiting elements may be fixed, e.g., lugs, or, preferably, adjustable, the latter, being the case in FIGS. 1, 3 and 4**, where the motion-limiting elements are threaded to permit their being screwed in or out until the desired path and displacement is obtained for the movable element.

It is noted that the provision of the motion-limiting elements to the display apparatus of the present invention permits the movable element to be positioned with a relatively high degree of accuracy so that superior alignment is achieved between the light-transmitting regions of the selection element and the information bits of the storage element. These significant advantages are thus achieved with a relatively inexpensive structural feature, viz., the motion-limiting elements, that do not carry the operational criticality, precision requirements, cost, or susceptibility to failure that are encountered with prior art devices described above.

The intelligence selection element 16 (FIG. 5) has alternating first and second regions 100 and 102, respectively, the former being transmissive, preferably substantially transparent, to light from the illumination source (22 in FIG. 1) that passes through the intelligence storage element such as 17 (FIG. 1). Each one of the transparent first regions 100 is surrounded by second regions 102 that are substantially opaque to, the light received from the storage element 17.

Preferably, the first regions 100 are substantially rectangular in shape, substantially square first regions being especially preferred. The first regions 100 can be evenly spaced from each other and arranged in rows and columns, as shown in FIG. 5, or in some other pattern, although the row-and-column arrangement is most preferred.

The intelligence storage element 17 with which the intelligence selection element 16 is used, preferably contains four interspersed sets of intelligence, each of which sets comprises one or, preferably, plural bits of information that together form a composite of the information or intelligence contained in each set. In this situaltion, the intelligence selection element 16 is provided with transparent first regions 100 that substantially coincide with and are at least substantially equal in size with the various bits of one of the intelligence sets when the storage and selection elements are properly aligned. Therefore, as the selection element 16 is moved in a rectangular path in the manner described above, it will sequentially assume four different stations along this path and, by employing a suitable step motor, gears, or other means (e.g., a proper cam plate configuration and a semi-rigid cam drive rod), can be caused to dwell at one or more of these stations for a predetermined time to permit viewing of each set of intelligence in sequence. Where the selection and storage elements are properly aligned initially, only one set of intelligence will be viewable at a certain time, although it is possible with the present invention in a modified form, to view simultaneously two or more sets of intelligence or the respective parts of two or more such sets. An example of such modification is the utilization of a selection element with transparent first regions that exceed in size the various intelligence bits so that at least respective portions of two or more bits can be viewed simultaneously or the pre-disposition of the motion-limiting elements such that each of transparent first region of the selection elelment coincides with respective portions of two or more bits of intelligence (which may be desirable where the display apparatus is utilized to produce multicolored light, the bits of each set being of a different color).

The intelligence selection element 16 can be produced from plastic, glass, metal or any other material that is or can be made opaque to the light transmitted. The transparent first regions of the selection element can be produced in a sheet or other body of opaque material (e.g., metal) by etching, punching or otherwise producing apertures therein, while a sheet or other body of transparent material can be provided with transparent first region by opaquing all of a surface thereof except those areas where the first regions are to be located. Such opaquing can be done by painting, metallizing, etching, etc., the transparent sheet.

In one mode of operating a display apparatus including a four-information set intelligence storage element with an intelligence selection element 16 (either being movable), each transparent first region 100 coincides with a respective information bit 110 of one of these sets, the first region 100 transmitting substantially only the light transmitted by the bit 110 aligned therewith, but blocking light transmitted by the other bits 112, 114 and 116 of respective other sets that are desired to be viewed at some other time. The adjustment of the storage and selection elements such that the first region of the latter is properly aligned with a bit of the former, can be achieved by adjusting the motion-limiting elements (FIG. 1) and/or the cam assembly (FIG. 1), for example.

Figure 8:
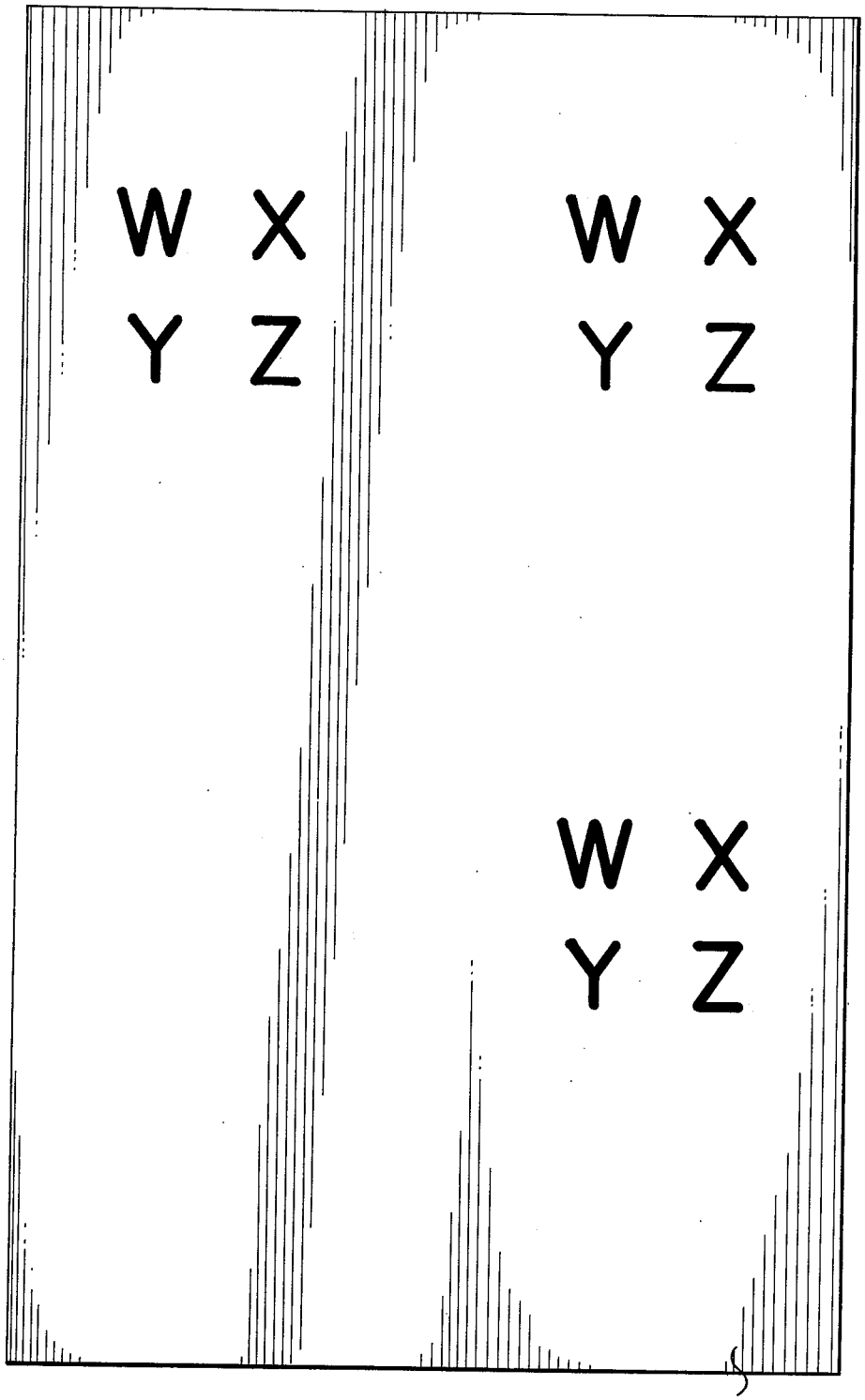
FIG. 8 is a front view of the information storage element, which, in this embodiment, contains four interspersed sets of intelligence.

As shown in FIG. 6, the transparent first region 100 is aligned with the first bit 110, but as the movable selection element (or, alternatively the storage element) is driven horizontally, the movable element assumes a second position where the first region (shown in as dot-dash lines 100a) is aligned with a second information bit 112. As the movable element continues to be driven, the cam assembly (in conjunction with motion-limiting elements, if any be present) vertically displaces the movable element to a third position where the first region (100b) is aligned with a third information bit 114 and so on for the fourth position, where the first region (100c) is horizontally shifted so as to be aligned with bit 116, after which the movable element is displaced vertically to the first position. It can be seen that providing opaque regions that are wider than the transmitting regions 100 results in less than the entire storage element being viewable, the "blind spots" 119 between the exposed parts of the bits 110, 112, etc. reducing and often eliminating the simultaneous exposure of more than one set of information, where such exposure is undesired. The information storage element (FIG. 8) can comprise, e.g. four interspersed sets of intelligence, i.e. all of W's together can comprise one such set, all the X's another such set, and so forth. While letters have been used to indicate the various intelligence sets, other forms may be used, e.g. numerals, parts of a picture that together constitute the picture (with, in this case, four pictures being possible).

It is particularly important and very much preferred that, where the transmissive first regions 100 of the selection element are rectangular (e. g., FIG. 6), the ratio of the width (A) of a transmissive first region to the width (B) of an opaque second region be in the range of about 6:7 to 8:9, preferably about 6:7 to 7:8 with smaller transmissive regions and most preferably about 6:7 (especially where the regions are about 0.06 inces on each side). With larger size transmissive regions (e. g., up to about ½ inch on a side) smaller size differences can exist (e. g., 8:9) since viewing is usually from a distance in these cases and the parallax problem is significantly attenuated. It is preferred that such a mask be employed with an information storage element containing four sets of information, it having been found that a 6:7 width ratio of the first and second regions minimizes image distortions, particularly for selection masks having relatively small transmission regions, including parallax, to which prior art devices might be susceptible. Because the parallax problem is substantially overcome by the present invention, the output of the display device of the present invention, can be observed over a relatively broad viewing angle. For example, where the first regions are rectangular and about 0.06 inches on a side and are spaced apart from their nearest neighbors by a minimum distance of about 0.07 inches (i.e., the width of the opaque second regions is about 0.07 inches) an image produced by the display device can be observed with good quality, over a viewing angle of up to about 45°, with some relatively small sacrifice in image quality as the viewing angle is increased. The devices of the present invention can have viewing areas of relatively large size (e.g., up to about 12 feet or more).

The intelligence storage element can be produced, for example, by exposing photographic film to information — or image-carrying light that is passed through an intelligence selection element, the selection element being shifted (e.g., vertically and/or horizontally) to different positions, preferably four in number, to expose in sequence, four different parts of the film after which the film can be developed and incorporated into the display apparatus and used as described above.

The female cam plate 38 (FIG. 7) preferably includes slots permitting the adjustable connection of the plate 38 to the movable element of the display apparatus associated therewith (FIG. 2). The cam drive rod 36 fits into and egages the socket portion 39 of the cam plate. The different positions assumed by the cam plate 38 as it is driven are shown in FIG. 7, where the dash lines A′ through D′ indicate the relative positions of the edges A through D, respectively, over the entire motion cycle of the cam plate. It is advantageous that the socket 39 have a generally square configuration where the light transmissive regions are of the same general configuration and a generally elliptical configuration where the transmissive regions are rectangular.

It can readily be seen that the present invention affords significant advantages over the prior art, including high quality images without the need for precision components, lower cost, and a simplified structure. Thus, the present invention can be employed for displaying intelligence, including for example, data, pictures, color patterns, written material and so forth.

As used herein, the terms "intelligence" and "information" include letters, words, colors, images, figures, numerals, etc., whether or not same are such as to collectively form a word or picture.

It should be emphasized that an outstanding advantage of the present invention believed not to be available in prior art devices, is that the intelligence display apparatus can be made to practically umlimited size, e.g., 12 feet or more on one or both sides, such as one or both dimensions of length and width, of 20 fee or 35 feet, with the attendant advantage that image resolution is not impaired but, in fact, is actually improved with such larger size display apparatus, thus by reason of the fact that a greater number of information bits, each containing a smaller proportion of the total image, can be utilized in the present invention. The drive means of the present invention can include a step motor or a motor operated by a timing switch so that it operates at certain intervals.

I claim:

1. An intelligence display apparatus comprising:

(a) an envelope comprising a substantially transparent faceplate;

(b) illumination means for directing light toward said faceplate;

(c) an intelligence selection element disposed in said envelope and between said faceplate and said illumination means, said selection element comprising first regions substantially transparent to said light and second regions substantially opaque thereto, said first and second regions having respective widths in the ratio of about 6:7 to about 8:9;

(d) an intelligence storage element comprising a plurality of discrete and different sets of intelligence, said storage element being disposed in said envelope and between said selection element and said illumination means, said sets individually comprising a plurality of bits respectively embodying different portions of said intelligence, such that said bits of each set collectively comprises a composite of the intelligence of said set, each one of said bits being totally opaque, totally transparent, or both partially opaque and partially transparent to said light said bits of a certain said set of intelligence being substantially aligned with said first regions and the bits of the respective said sets including said certain set, of intelligence are sequentially substantially aligned with said first regions when at least one of said information selection element and said intelligence storage element is moved relative to the other, certain said sets being aligned with said said first regions at certain times and other said sets being not so aligned and another said set being so aligned at another time, said intelligence storage element and said intelligence selection element comprising a unitary structure; and (e) means for moving at least one of said selection element and said storage element with respect to the other so that said bits of respective ones of said sets are sequentially observable through said first regions.

2. An intelligence display apparatus as recited in claim 1, further comprising means for limiting the motion of the movable one of said storage element and said selection element such motion limiting means directly engaging said movable element and being separate from said moving means.

3. An intelligence display apparatus as recited in claim 2, wherein said motion-limiting means comprises adjustable elements disposed on said movable one of said storage element and said selection element.

4. An intelligence display apparatus as recited in claim 1, further comprising a protective plate substantially transparent to said light and disposed between said storage element and said illumination means, wherein said faceplate, selection element, storage element, and protective plate comprise a unitary structure, said unitary structure further comprising a peripheral wall portion surrounding said selection and storage elements.

5. An intelligence display apparatus as recited in claim 4, further comprising motion-limiting elements disposed at said peripheral wall portion.

6. An intelligence display device as defined in claim 5, wherein said motion-limiting elements are adjustable, so as to vary the displacement of said movable one of the said selection and storage elements.

7. An intelligence display device as defined in claim 4, further comprising stationary motion-limiting elements disposed at said peripheral wall portion.

8. An intelligence display device as defined in claim 1, further comprising motion-limiting elements disposed at the interior surface of said envelope, said motion-limiting elements being adapted to engage said movable one of the storage and selection elements.

9. An intelligence display device as recited in claim 1, wherein said moving means comprises an adjustable cam assembly.

10. An intelligence display apparatus as recited in claim 1, further comprising a light diffusing element disposed between said storage element and said selection element, said diffusing element transmitting said light.

11. An intelligence display apparatus as defined in claim 1, wherein said storage element contains four sets of intelligence and said bits of one of said sets are interspersed among other ones of said bits of other ones of said sets.

12. An intelligence display device as recited in claim 1, wherein said moving means comprises a cam assembly comprising at least one female cam plate disposed on said movable element and a drive rod engaging said cam plate.

13. An intelligence display device as recited in claim 12, wherein said drive rod is substantially semi-rigid.

14. An intelligence display device as recited in claim 12, wherein said moving means comprises a motor, first and second said female cam plates, at least first and second said drive rods respectively engaging said cam plates, and first and second drive shafts, respectively linked to said first and second drive rods, said first drive shaft being driven by said motor and mechanically linked to said second drive shaft.

15. An intelligence display device as recited in claim 1, wherein said faceplate consists of tinted material.

16. An intelligence display apparatus comprising:

(a) an envelope comprising a substantially transparent faceplate;

(b) illumination means for directing light toward said faceplate;

(c) an intelligence selection element disposed in said envelope and between said faceplate and said illumination means, said selection element comprising first regions substantially transparent to said light and second regions substantially opaque thereto;

(d) an intelligence storage element comprising a plurality of discrete and different sets of intelligence, said storage element being disposed in said envelope and between said selection element and said illumination means, said sets individually comprising a plurality of bits respectively embodying different portions of said intelligence, such that said bits of each set collectively comprise a composite of the intelligence of said set, each one of said bits being totally opaque, totally transparent, or both partially opaque and partially transparent to said light, said bits of a certain said set of intelligence being substantially aligned with said first regions and the bits of the respective said, including said certain set, intelligence are sequentially substantially aligned with said first regions when at least one of said intelligence selection element and said intelligence storage element is moved relative to the other; said intelligence storage and intelligence selection elements comprising a unitary structure;

(e) means for moving at least one of said selection element and said storage element with respect to the other so that said bits of respective ones of said sets are sequentially observable through said first regions; and (f) means for limiting the motion of the movable one of said storage element and said selection element, said motion limiting means being independent of said moving means and in direct contact with and directly engaging said movable one of said storage element and said selection element.

* * * * *